US011284705B1

(12) United States Patent
Correa et al.

(10) Patent No.: US 11,284,705 B1
(45) Date of Patent: Mar. 29, 2022

(54) PAINT BRUSH

(71) Applicants: Yulie Correa, Miami, FL (US); Maylen Santos, Miami, FL (US)

(72) Inventors: Yulie Correa, Miami, FL (US); Maylen Santos, Miami, FL (US)

( * ) Notice: Subject to any disclaimer, the term of this patent is extended or adjusted under 35 U.S.C. 154(b) by 0 days.

(21) Appl. No.: 17/165,254

(22) Filed: Feb. 2, 2021

(51) Int. Cl.

| | |
|---|---|
| ***A46B 11/00*** | (2006.01) |
| ***A46B 5/00*** | (2006.01) |
| ***A46B 15/00*** | (2006.01) |
| ***B05C 17/02*** | (2006.01) |
| ***B05C 17/025*** | (2006.01) |
| ***B05C 17/03*** | (2006.01) |

(52) U.S. Cl.
CPC ..... *A46B 11/0006* (2013.01); *A46B 5/005* (2013.01); *A46B 5/0095* (2013.01); *A46B 11/0079* (2013.01); *A46B 15/0055* (2013.01); *B05C 17/02* (2013.01); *B05C 17/025* (2013.01); *B05C 17/0235* (2013.01); *B05C 17/03* (2013.01); *A46B 2200/202* (2013.01)

(58) Field of Classification Search
CPC ... A46B 11/00; A46B 11/0006; A46B 11/001; A46B 11/0072; A46B 11/0079; A46B 5/0095; A46B 5/005; A46B 2200/202; A46B 15/0055; B05C 17/02; B05C 17/0205; B05C 17/0215; B05C 17/0222; B05C 17/0235; B05C 17/025; B05C 17/0245; B05C 17/03
USPC ..... 401/16, 23, 24, 270, 218–220; 15/114, 15/105, 106, 230.11
See application file for complete search history.

(56) References Cited

U.S. PATENT DOCUMENTS

| | | | | |
|---|---|---|---|---|
| 2,785,425 A | 3/1957 | Lenk | | |
| 2,820,233 A | 1/1958 | Steiner | | |
| 4,100,642 A * | 7/1978 | Gabor | A46B 15/00 | 15/114 |
| 4,528,712 A * | 7/1985 | Leibow | B05C 17/00 | 15/118 |
| 8,025,022 B1 * | 9/2011 | Morris | B05C 17/0235 | 118/258 |
| 2002/0148058 A1 * | 10/2002 | Greenwood | A46B 7/04 | 15/168 |

* cited by examiner

*Primary Examiner* — David J Walczak
(74) *Attorney, Agent, or Firm* — Sanchelima & Associates, P.A.; Christian Sanchelima; Jesus Sanchelima

(57) ABSTRACT

A system for a paint brush including a brush head assembly and a reservoir assembly. The brush head assembly includes a brush head with bristles for painting a surface. In between the bristles is a roller brush in abutting contact with the bristles. The reservoir assembly includes a reservoir handle removably mounted to the brush head. The reservoir handle is filled with fresh paint to supply to the brush head to dispense. The reservoir handle is squeezed to allow the fresh paint to travel to the brush head and then soak the roller brush. The roller brush then allows for excess fresh paint to flow onto the bristles to allow users to paint the desired surface with the fresh paint on the bristles. The brush head further includes wheels that facilitate the maneuvering of the paint brush. Thereby allowing for painting to be done more efficiently.

20 Claims, 3 Drawing Sheets

PAINT BRUSH

BACKGROUND OF THE INVENTION

1. Field of the Invention

The present invention relates to a paint brush and, more particularly, to a paint brush that can store and dispense fresh paint from the brush head.

2. Description of the Related Art

Several designs for paint brushes have been designed in the past. None of them, however, include a paint brush comprising a hollow reservoir handle wherein paint can be poured into for supplying the brush head with fresh paint.

Applicant believes that a related reference corresponds to U.S. Pat. No. 2,785,425 for a paint dispensing paint brush. Applicant believes that another related reference corresponds to U.S. Pat. No. 2,820,233 for a paint brush with a hollow handle for supplying the brush head with fresh paint. None of these references, however, teach of a brush head with wheels to facilitate maneuvering of the paint brush while painting.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a paint brush capable of readily supplying fresh paint.

It is another object of this invention to provide a paint brush that stores fresh paint within.

It is still another object of the present invention to provide a paint brush that facilitates the task of painting.

It is also another object of the present invention to provide a paint brush that makes a user for efficient during painting.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
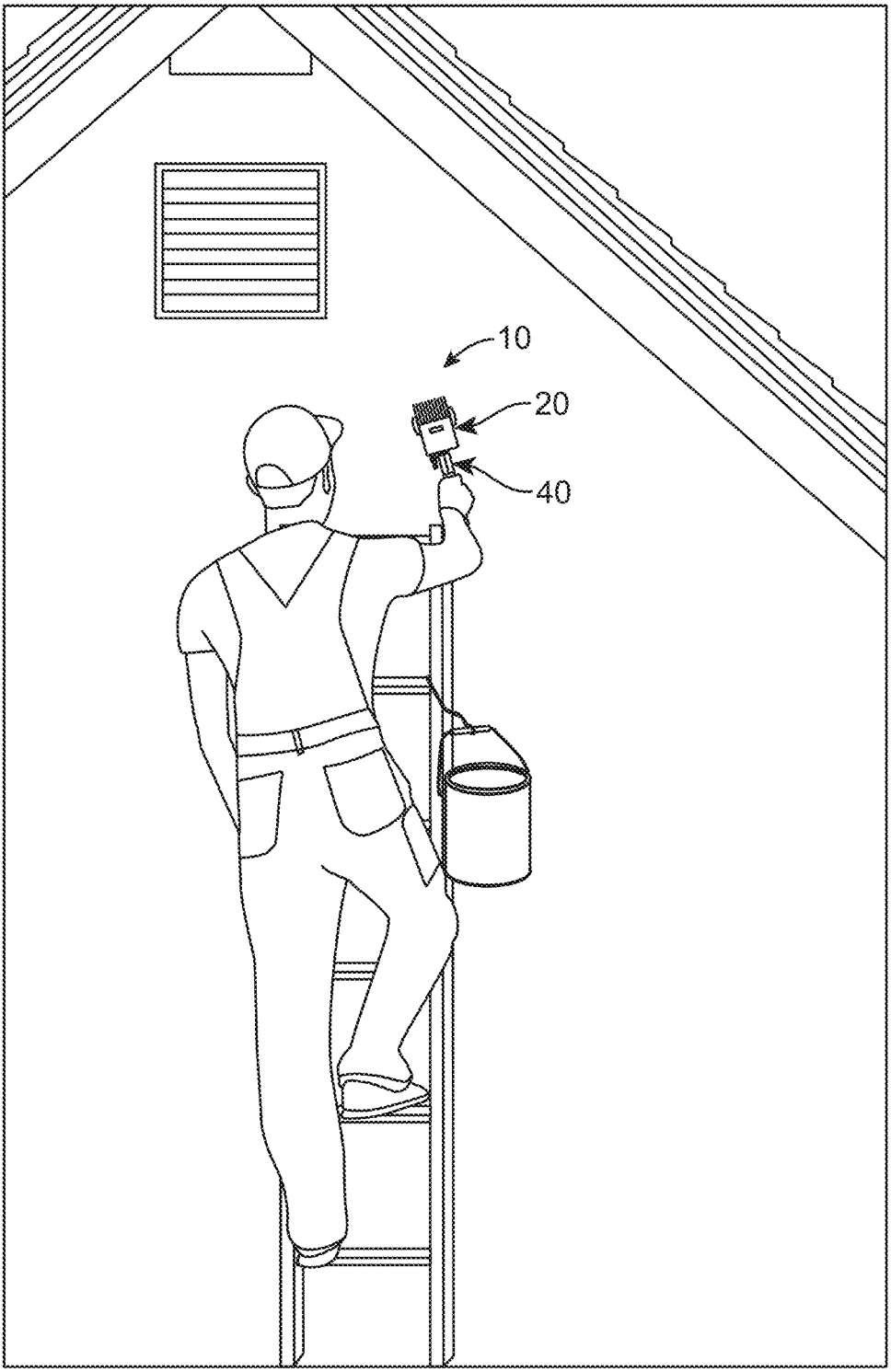
FIG. 1 represents an operational view of a user using paint brush 10 to paint a wall.

Referring now to the drawings, where the present invention is generally referred to with numeral 10, it can be observed that it basically includes brush head assembly 20 and a reservoir assembly 40.

Painting is a tiresome and time-consuming task due to the inefficiency of the task. Painting of surfaces often requires that the paint brushes be dipped in fresh paint constantly. This become laborious and results in hours spent painting. A paint brush 10 may be used for more efficient painting as fresh paint is maintained readily available for painting. Paint brush 10 dispenses fresh paint from a reservoir built in.

As best seen in FIGS. 1-5, paint brush 10 may include brush head assembly 20. Brush head assembly 20 may be used to dispense fresh paint for continuous and efficient painting. Brush head assembly 20 may include a brush head 22. Brush head 22 may be substantially hollow. Fresh paint that is to be dispensed may be stored within brush head 22. Additionally, the same fresh paint may be dispensed by brush head 22.

In one embodiment, brush head 22 may be substantially rectangular in shape. It may be suitable for brush head 22 to be made of materials such as wood, plastic, rubber, aluminum, metal, steel or combinations thereof. Brush head 22 may be transparent in one embodiment. Importantly, there may be an opening at the top end of brush head 22 which extends the length of brush head 22.

Brush head 22 may further include a brush neck 24 centrally located at a bottom distal end thereof. Brush neck 24 may be used to attach brush head assembly 20 and reservoir assembly 40 together. Brush neck 24 may extend outwardly and away from brush head 22. Brush head 22 and brush neck 24 may be integral, in the preferred embodiment. It can be seen, in FIGS. 3-4, that brush head 22 and brush neck 24 may be in constant abutting contact with each other. Brush neck 24 may in cylindrical in shape, in one embodiment. Brush neck 24 may include a neck opening 26 which extends entirely through brush neck 24. Neck opening 26 leads to an interior of brush head 22. Fresh paint may be provided within brush head 22 through neck opening 26. The interior of brush head 22 may be cleansed through neck opening 26. Brush neck 24 may include neck threads 28. Neck threads 28 may extend about the outer perimeter of brush neck 24. Neck threads 28 may facilitate attaching brush head assembly 20 to reservoir assembly 40. In one embodiment, a stopper member may extend about the outer perimeter of brush neck 24 and above of neck threads 28. The stopper member may flare outwardly and away from brush neck 24. The stopper member allowing brush head assembly 20 and reservoir assembly 40 to removably attach properly.

Figure 4:
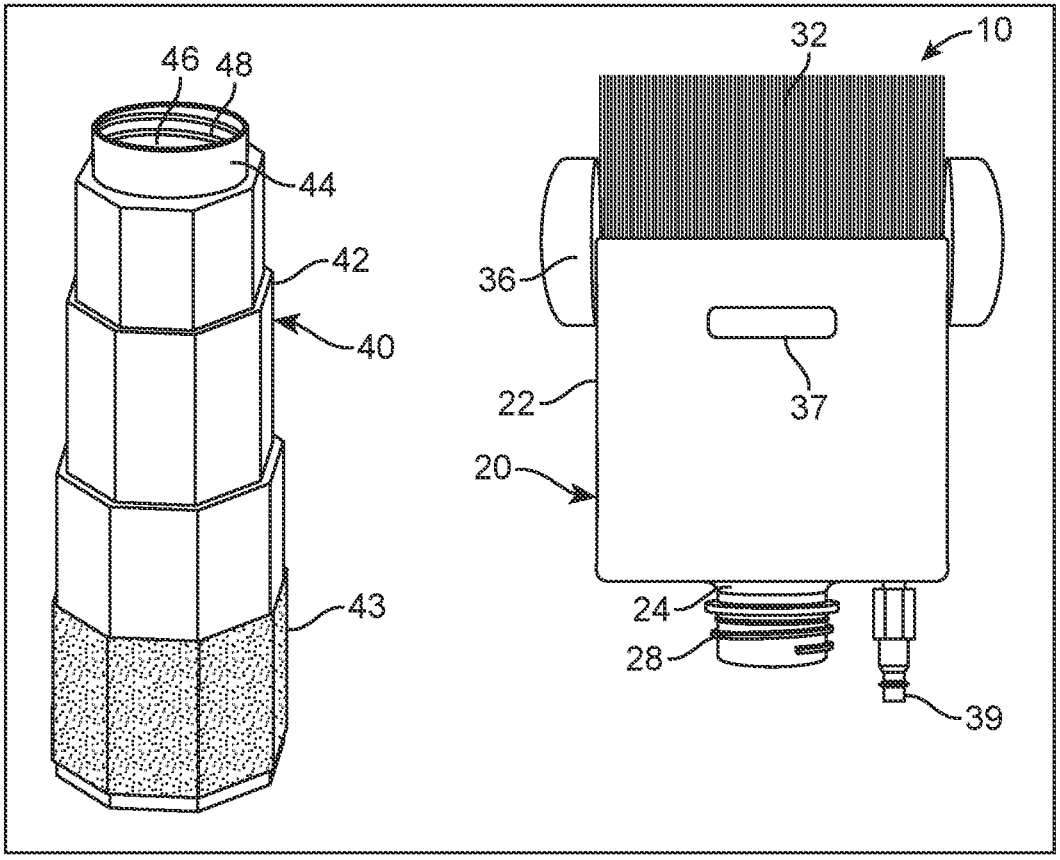
FIG. 4 is a representation of an isometric view of brush head 22 and reservoir handle 42 detached for refilling.
Figure 5:
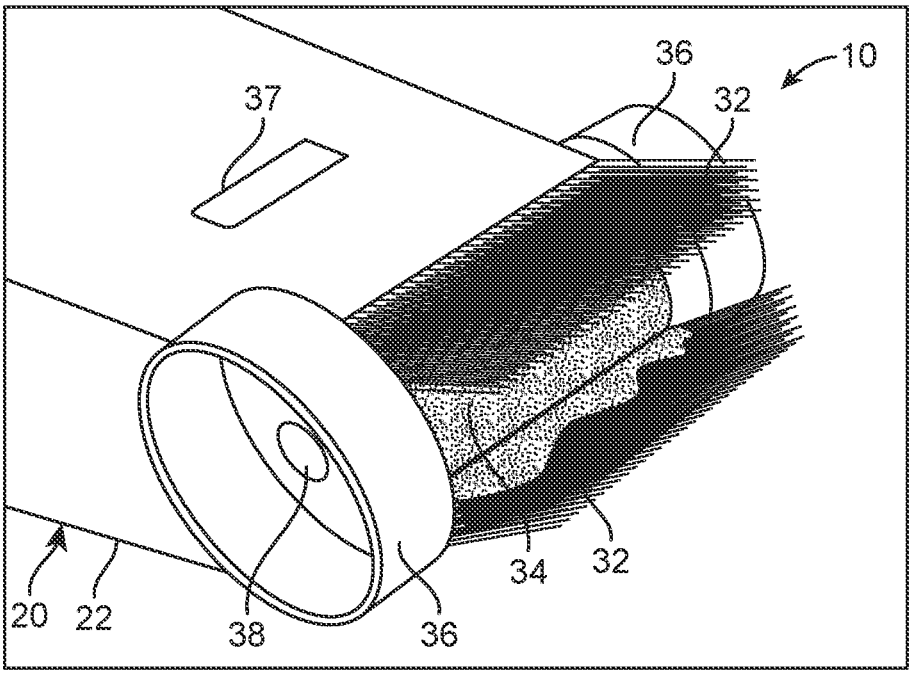
FIG. 5 represents a zoomed in view of brush head 22 showing bristles 32 and roller brush 34 therebetween, with roller brush 34 being covered in fresh paint that is being dispensed.

Located at a top end of brush head 22 may be bristles 32, as best seen in FIGS. 1-5. Bristles 32 may be used for painting on the desired surface. Bristles 32 may extend the entire length of brush head 22 along two opposite top lateral edges of brush head 22, as best shown in FIG. 5. Further, bristles 32 may extend vertically. Bristles 32 may be parallel to each other. It is to be understood that bristles 32 may be substantially in constant abutting contact with each other along each of the top lateral edges of brush head 22. It may be suitable for bristles 32 to be made of natural hairs or synthetic fibers. In one embodiment, bristles 32 may be detachable and disposable. Bristles 32 may be replaced with new and clean of bristles 32. Brush head 22 may include a slot to receive and secure bristles 32 thereto.

Importantly, as best seen in FIG. 5, mounted to the top end of brush head 22 may be a roller brush 34 for dispensing fresh paint. It can be best seen in FIG. 5, that roller brush 34 may be between bristles 32. Roller brush 34 may be perpendicular to bristles 32. It may be suitable for roller brush 34 to be in constant abutting contact with bristles 32. Roller brush 34 may help to control the flow of fresh paint from within brush head 22 onto bristles 32. Roller brush 34 may entirely seal the top end of brush head 22. It is to be understood that roller brush 34 may extend the entire length of brush head 22. Roller brush 34 may preferably be made of an absorbent material. Fresh paint with brush head 22 may seep out of brush head 22 through roller brush 34. Roller brush 34 may become entirely covered with fresh paint from with brush head 22. Roller brush 34 may then dispense the fresh paint. The excess fresh paint on roller brush 34 may then flow onto bristles 32 for painting. In one embodiment, roller brush 34 may rotate when secured atop of brush head 22. In an alternate embodiment, roller brush 34 may remain stationary when secured atop of brush head 22.

Mounted to the distal ends of roller brush 34 may be wheels 36. Wheels 36 may be secured to roller brush 34 with a fastener 38. It is to be understood that wheels 36 may be adjacent to roller brush 34 and bristles 32 simultaneously. Wheels 36 may rotate to facilitate the maneuvering of paint brush 10 when painting. Wheels 36 help to facilitate the painting process by allowing users to use minimal effort when painting. Pushing and pulling of paint brush 10 is easier and quicker with wheels 36. Wheels 36 may be parallel to each other. Wheels 36 may be adjacent to and extend a partial height of brush head 22. It is to be understood that wheels 36 may extend substantially above of brush head 22.

It can be seen that underneath of brush head 22 may be an attachment member 39. Attachment member 39 may be used to secure a hose attached to a paint supply to brush head 22. Thereby allowing for brush head 22 to be provided with a constant supply of paint. This facilitates painting of large areas or spaces. It can be seen that attachment member extends downwardly and away from brush head 22. Attachment member 39 may be threaded for secure attachment of the hose to be received. Attachment member may also be tapered, in one embodiment. It can be seen that attachment member 39 may have a length greater than brush neck 24.

Secured to said brush head 22 may be at least one light 37. It is to be understood that light 37 may emit light to facilitate painting in the dark such as at night. Light 37 may emit light towards and beyond bristles 32. Light 37 may retract in and out of brush head 22 in one embodiment. It may be suitable for light 37 to be an LED light. It may be suitable for light to emit different colored lights. It is to be understood that the present invention may include a power source, such as a battery, to provide power to light 37.

Figure 2:
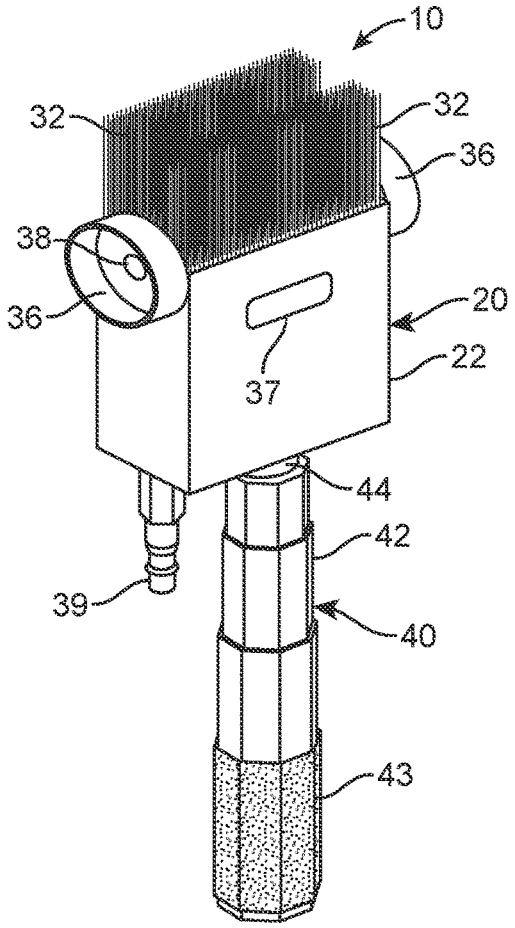
FIG. 2 shows an isometric view of paint brush 10.
Figure 3:
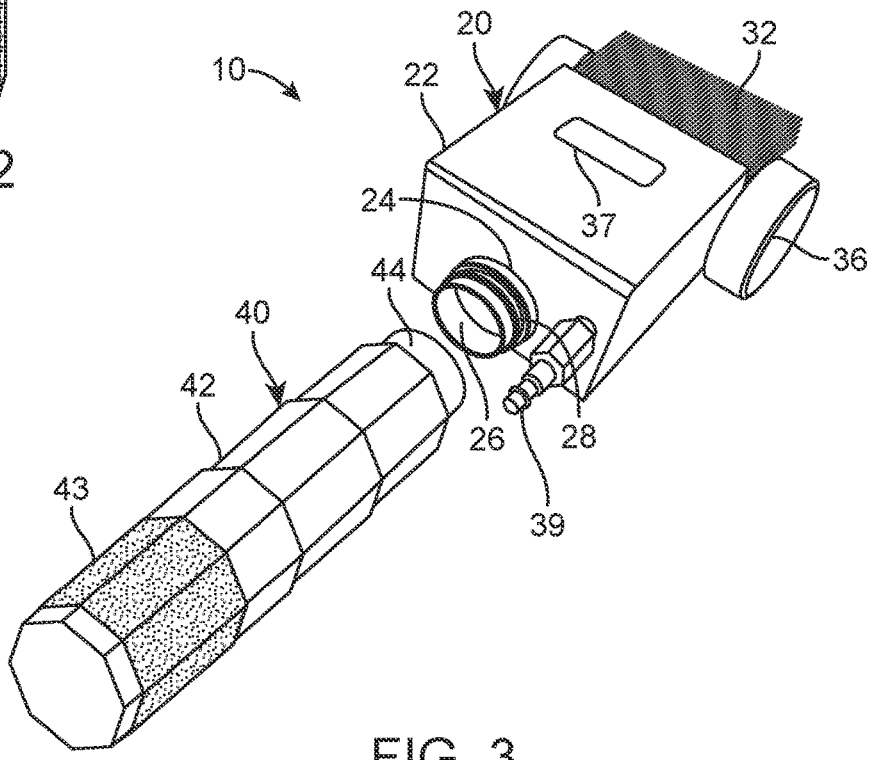
FIG. 3 illustrates a dissembled view of paint brush 10 with brush head assembly 20 detached from reservoir assembly 40.

Removably mounted to brush head 22 may be reservoir assembly 40, as best seen in FIG. 2. Reservoir assembly 40 may include a reservoir handle 42. Reservoir handle 42 may be hollow. Reservoir handle 42 may be used to store a reservoir of fresh paint to be dispensed when paint brush 10 is in use. Reservoir handle 42 may be squeezable to transfer the fresh paint stored within reservoir handle 42 to brush head 22. In one embodiment, reservoir handle 42 may be substantially rectangular or octagonal in shape. It may be suitable for reservoir handle 42 to be made of materials such as wood, plastic, rubber, aluminum, metal, steel or combinations thereof. It is to be understood that brush head 22 and reservoir handle 42 may be selectively attached. Detachment of reservoir handle 42 from brush head 22 may be suitable when there is a need to refill reservoir handle 42 with fresh paint. Attachment member 39 may extend a partial length of reservoir handle 42. It can be seen that attachment member 39 and reservoir handle 42 may be parallel to each other. In one embodiment, reservoir handle 42 may be telescopic. Thereby allowing for reservoir handle 42 to be able to carry a higher volume of fresh paint. Reservoir handle 42 may be extended as needed to hold additional fresh paint. It may be suitable for reservoir handle 42 to include a grip 43 extending about a perimeter thereof. Grip 43 may help users to be able to better grasp reservoir handle 42. In one embodiment, grip 43 may extend a partial length of reservoir handle 42. It may be suitable for grip 43 to be made of memory foam, in one embodiment.

To allow the interconnection of brush head 22 and reservoir handle 42, reservoir handle 42 may include a handle neck 44. It is to be understood that brush neck 24 and handle neck 44 may cooperate with one another to attach brush head 22 and reservoir handle 42 together. Handle neck 44 may be located at a top distalmost end of reservoir handle 42. It can be seen that, in one embodiment, handle neck 44 may be circular. Handle neck 44 may extend outwardly and away from reservoir handle 42. Preferably, reservoir handle 42 and handle neck 44 may be integral to each other. Handle neck 44 may include a neck opening 46 that may extend entirely through handle neck 44. Neck opening 46 may lead to an interior of reservoir handle 42. Fresh paint can come in and out of reservoir handle 42 through neck opening 46. Refilling of reservoir handle 42 may be done through neck opening 46. Located along an inner perimeter of handle neck 44 may be handle threads 48, as best seen in FIG. 4. Neck thread 28 and handle threads 48 may cooperate with each other to secure brush head 22 and reservoir handle 42 together. Brush neck 24 may be substantially covered by handle neck 44 when secured together. Thereby allowing for fresh paint within reservoir handle 42 to flow into brush head 22 to be dispensed.

Paint brush 10 may be used to expediate the process of painting. With increased efficiency users are able to complete more painting of desired surfaces. Paint brush 10 includes reservoir handle 42 which can be refilled to supply fresh paint to brush head 22 for dispensing and painting.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a paint brush, comprising:

a) a brush head assembly including a brush head, said brush head including bristles mounted to said brush head, said brush head further including a roller brush secured between said bristles; and b) a reservoir assembly including a reservoir handle, said reservoir handle removably secured to said brush head, said reservoir handle adapted to being filled with fresh paint, said fresh paint traveling from said reservoir handle to said brush head for dispensing, said fresh paint soaking said roller brush, said roller brush dispensing excess of said fresh paint onto said bristles by causing said fresh paint to flow onto said bristles, said bristles adapted to paint a desired surface with said fresh paint thereon.

2. The system of claim 1, wherein said bristles extend vertically, said bristles being parallel to each other.

3. The system of claim 1, wherein said bristles extending horizontally an entire length of said brush head along two opposite lateral edges of said brush head.

4. The system of claim 1, wherein said brush head includes a brush neck at a bottom distal end thereof, said brush neck extending outwardly and away from said brush head.

5. The system of claim 4, wherein said brush neck is integral to said brush head.

6. The system of claim 4, wherein said brush neck includes a neck opening, said neck opening leading to an interior of said brush head.

7. The system of claim 4, wherein said brush neck includes neck threads extending about an outer perimeter of said brush neck.

8. The system of claim 1, wherein said brush head further includes wheels, said wheels secured to distal ends of said roller brush with a fastener, said wheels facilitating the maneuvering of said paint brush.

9. The system of claim 8, wherein said wheels are adjacent to said brush head and said bristles simultaneously, said wheels extend a partial height of said brush head, said wheels extending substantially above of said brush head, said wheels being parallel to each other.

10. The system of claim 7, wherein said reservoir handle includes a handle neck, said handle neck being at a top distal end of said reservoir handle.

11. The system of claim 10, wherein said handle neck is secured to said brush neck, said brush neck substantially covered by said handle neck when secured together.

12. The system of claim 10, wherein said handle neck includes a neck opening, said neck opening leading to an interior of said reservoir handle, said reservoir handle adapted to being refilled with said fresh paint through said neck opening.

13. The system of claim 10, wherein said handle neck includes handle threads extending along an inner perimeter of said handle neck, said handle threads cooperating with said neck threads to secure said brush head and said reservoir handle together.

14. The system of claim 1, wherein said reservoir handle is hollow.

15. The system of claim 1, wherein said bristles and said roller brush are perpendicular to each other.

16. The system of claim 1, wherein entirely underneath of said brush head is an attachment member adapted to receive a hose from a paint supply, thereby permitting for brush head to be supplied with a constant supply of said fresh paint.

17. The system of claim 16, wherein said attachment member extends a partial length of said reservoir handle.

18. The system of claim 1, wherein said reservoir handle is telescopic.

19. The system of claim 1, wherein attached to said brush head is a light that illuminates said bristles.

20. The system of claim 1, wherein attached about a perimeter of said reservoir handle is a grip, said grip being made of memory foam.

* * * * *